United States Patent [19]

Negi

[11] 3,948,535

[45] Apr. 6, 1976

[54] SKI-EQUIPPED CRUTCH

[75] Inventor: Takafusa Negi, Hamamatsu, Japan

[73] Assignee: Nippon Gakki Seizo Kabushiki Kaisha, Japan

[22] Filed: May 8, 1975

[21] Appl. No.: 575,701

Related U.S. Application Data

[63] Continuation of Ser. No. 420,090, Nov. 29, 1973, abandoned.

[30] Foreign Application Priority Data

Dec. 2, 1972 Japan ..... 47-120981
Dec. 2, 1972 Japan ..... 47-120982

[52] U.S. Cl. ..... 280/11.37 B; 135/47; 403/93
[51] Int. Cl.[2] ..... A63C 11/22
[58] Field of Search 280/11.37 B, 11.37 R, 11.37 J; 135/54, 62, 49, 55, 47; 403/93, 95

[56] References Cited

UNITED STATES PATENTS

| | | | |
|---|---|---|---|
| 1,035,760 | 8/1912 | Walton | 135/50 |
| 1,621,255 | 3/1927 | Hunter | 135/49 |
| 2,191,348 | 2/1940 | Lauterbach | 403/93 |
| 2,818,290 | 12/1957 | Harocopo | 280/11.37 |
| 3,273,575 | 9/1966 | Aldrich | 135/62 |
| 3,289,685 | 12/1966 | Parker | 135/45 |
| 3,456,663 | 7/1969 | Blum | 135/47 |
| 3,738,674 | 6/1973 | Pauls | 280/11.37 B |

FOREIGN PATENTS OR APPLICATIONS

| | | | |
|---|---|---|---|
| 1,967,123 | 8/1967 | Germany | 280/11.12 |

*Primary Examiner*—M. H. Wood, Jr.
*Assistant Examiner*—David M. Mitchell
*Attorney, Agent, or Firm*—Cushman, Darby & Cushman

[57] ABSTRACT

A ski-equipped crutch comprising a pole member, a pole-ski member detachably secured to the bottom of said pole member, and a holding member secured to the pole member and said pole-ski member to hold these two members so as to allow rotation of these two members relative to each other. Said holding member has an upright guide plate provided with an arcuate edge having spaced notches for selective engagement with a movable ball housed in said pole member and urged toward said arcuate edge by a spring. Said pole member further has a length-adjusting means comprising at least two separate portions one of which is received in the other and also comprising means for fastening these two portions tightly together at a desired position of these two portions selected from given positions. By loosening this fastening means, the pole member can be separated into parts for the convenience of transportation of the crutch. Moreover, the forward end of the pole-ski member has a cutout so that, when the pole-ski member is rotated toward the pole member, these two members are rendered into a rectilinear assembly without interference therebetween, thereby providing a walk-assisting cane structure.

4 Claims, 9 Drawing Figures

SKI-EQUIPPED CRUTCH

This is a continuation, of application Ser. No. 420,090 filed Nov. 29, 1973 now abandoned.

BACKGROUND OF THE INVENTION

1. Field of the invention

The present invention pertains to a ski-equipped crutch which is particularly suitable for use in performing skiing on a single ski.

2. Description of the prior art

Conventional ski-equipped crutches, especially their pole members, have difficulty in enabling their user in this skiing on a single ski to accomplish a timely effective control of these crutches to meet the various changes in the snow surface on which the user is skiing. Lack of such a function on the part of the ski-equipped crutches will result in the down-fall of the one-legged skier, leading often to an injury.

Especially, conventional ski-equipped crutches have difficulty in enabling the skier who skis on a single foot to unfailingly make the control of the speed of skiing. Furthermore, those ski-equipped crutches of the prior art have the inconvenience that when the pole-ski member is rotated toward the pole member, the edge of the bent top of the pole-ski member will hit the pole member, and therefore, these two members cannot be rotated sufficiently toward each other to provide an aligned superposed rectilinear structure to serve as a walk-assisting cane structure.

Furthermore, with known ski-equipped crutches it is unable to adjust the overall length of the pole member in conformity with the height of the user.

SUMMARY OF THE INVENTION

It is, therefore, a primary object of the present invention to provide an improved ski-equipped crutch which eliminates the aforesaid drawbacks and inconveniences of the ski-equipped crutches of the prior art.

Another object of the present invention is to provide an improved ski-equipped crutch which gives a great deal of safety in skiing on a single ski.

Still another object of the present invention is to provide an improved ski-equipped crutch which enables its user to instantaneously effect adequate control of the speed of skiing to meet various changes in the snow surface.

Yet another object of the present invention is to provide a ski-equipped crutch of the type described, which is free from the interference of the edge of the forward bent portion or the so-called "top bend" of the pole-ski member against the pole member when these two members are rotated toward each other, and which accordingly can be shifted into a superposed, aligned rectilinear structure from an inverted T-shape without any resistance by these two members.

A further object of the present invention is to provide a ski-equipped crutch of the type described, which can be easily controlled of its vertical overall length without replacing the parts thereof.

BRIEF DESCRIPTION OF THE DRAWINGS

Referring now to FIGS. 1 through 3, the ski-equipped crutch according to one aspect of the present invention is composed of three main members which are: a pole member generally indicated at 1, a pole-ski member 2 attached to the lower end of the pole member 1, and a holding member generally indicated at 3 for supporting both the pole member 1 and the pole-ski member generally indicated at 2.

Figure 1:
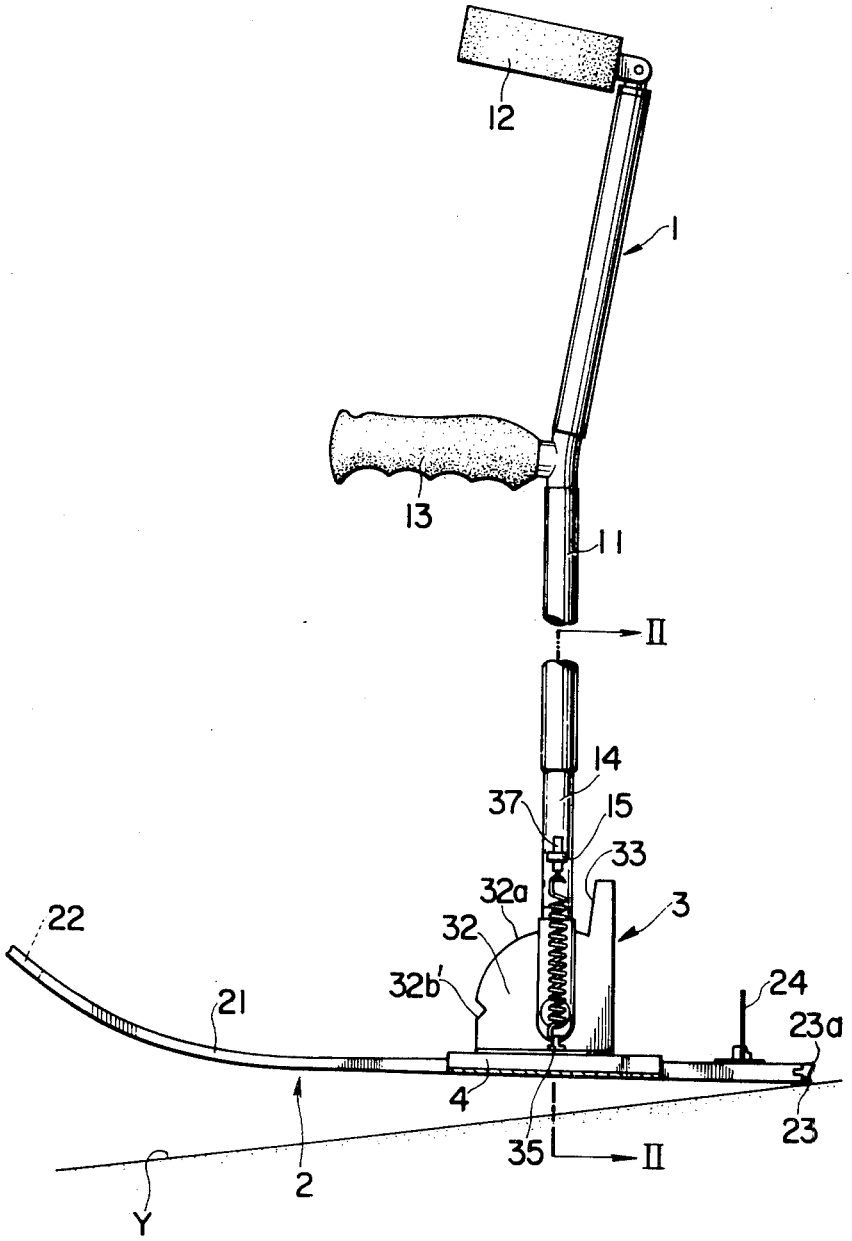
FIG. 1 is a side elevation of the ski-equipped crutch according to one aspect of the present invention.
Figure 3:
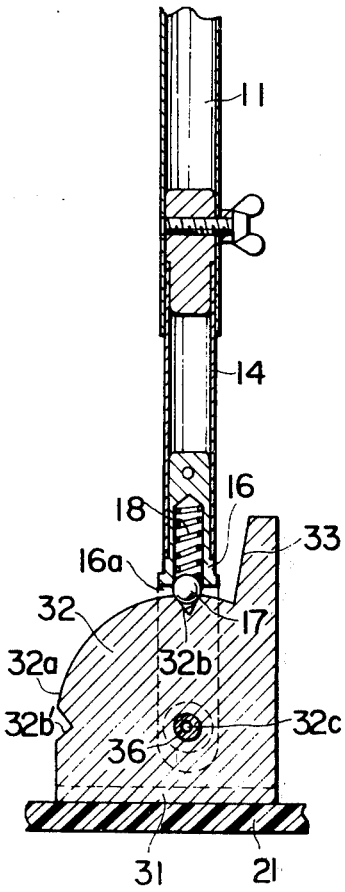
FIG. 3 is a sectional view taken along the line III—III of FIG. 2.
Figure 2:
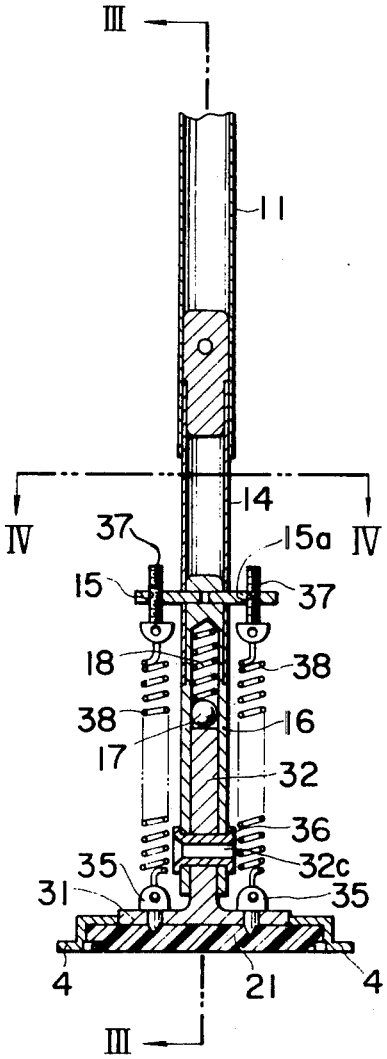
FIG. 2 is a sectional view taken along the line II—II of FIG. 1.
Figure 4:
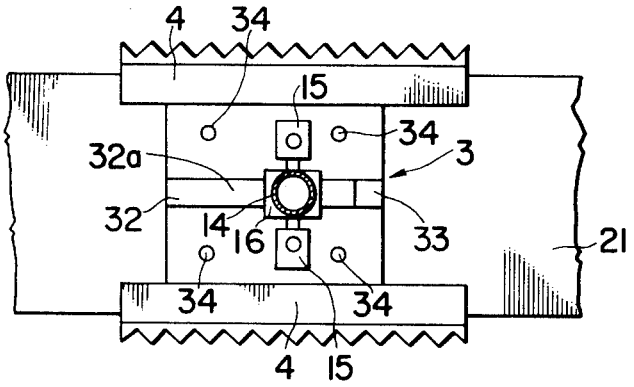
FIG. 4 is a sectional view taken along the line IV—IV of FIG. 2.
Figure 6:
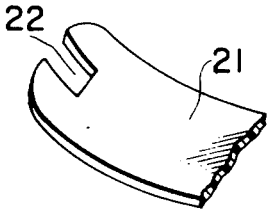
FIG. 6 is a perspective view of the forward end portion of the pole-ski member.

The pole member 1 is of the arrangement which comprises: a tubular pole body 11 which may be made of a light alloy such as aluminium, duralumin or the like and which is of a slightly bent upper end portion; an arm-receiving cuff or ring 12 provided at the upper end of the pole body 11 and adapted to put an arm of the user therethrough; and a handle 13 provided at the portion of the pole member 1 at which the pole body 11 is slightly bent, and projecting horizontally therefrom. In addition, the armreceiving ring 12 and the handle 13 are in a positional relationship that the former is located above the latter in such a way that the arm of the user inserted through the arm-receiving ring 12 is held at said portion and that the handle 13 can be positively grasped by a hand of the user.

The lower end of the pole body 11 is adjustably connected, as will be described later, to a lower end member 14 of a tubular shape which is slidably inserted in said lower end of the pole body 11. An arm 15 is provided at a site close to the lower end of the lower end member 14 to protrude from the outer surface thereof, after passing through this tubular lower end member 14, in a direction perpendicular to the longitudinal axis of this member 14. The arm 15 is provided with threaded through-holes **15*a* at the respective exposed portions thereof. An attachment member 16 is fixedly inserted through the tubular shaped lower end member 14 from its lower end for being attached to the holding member 3 which will be described later. The arm 15 also passes through the upper end portion of the attachment member 16. This attachment member 16 is provided with a bore 16*a* radially along the longitudinal axis of this attachment member 16, said bore 16*a* having a breadth sufficient for accommodating therein a guide plate which will be described later. In the space of the bore 16*a* is held a ball 17 in such a way that this ball is urged by a spring 18 in a direction in which the ball escapes from the space of said bore 16*a* and that, whenever a force greater than that of the spring 18** is applied to the ball externally thereof, the ball can retreat into the space.

The pole-ski member 2 is arranged so that a pole-ski body 21 is attached to the lower end of said pole member 1. At the center of the forward end portion of this pole-ski body 21 is formed a U-shaped cut-out 22, having a dimension, i.e., the breadth between the opposing inner walls thereof which is slightly larger than the outer diameter of the pole body 11 itself and the length of this cut-out 22 is of such a dimension that, in case the pole body 11 and the pole-ski body 21 are put together into an aligned straight line, the pole body 11 is accommodated in said cut-out 22 to avoid the collision of the forward end, i.e., the "top bend," of the pole-ski body 21 against the ski pole body 11.

Figure 5:
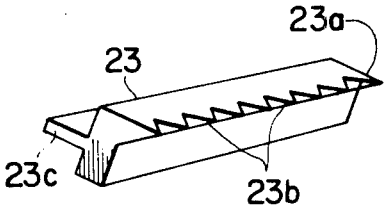
FIG. 5 is a perspective view of a rear protector.

At the rear end of the pole-ski body 21 is secured a rear protector 23 which has a breadth corresponding to the full breadth of the pole-ski body 21 and has, at its upper portion, an edge portion 23a which is formed with a sharp angle from its base as seen in FIG. 5. This edge portion 23a is provided with a plurality of projections 23b of a continuous serration shape like the shape of saw teeth. This rear protector 23 has a thickness equal to that of the pole-ski body 21. For the purpose of securing this rear protector 23 to the pole-ski body 21, an inlaying-type fixing projection 23c which is to be inserted securely into the rear end of the pole-ski body 21 is formed as an integral member of the rear protector 23. It should be understood, however, that this rear protector 23 may have any desired shape, not limited to the shape just described above, provided that a brake force is obtained when brought into the snow and that a satisfactory strength is acquired.

Furthermore, on the upper surface of the rear end portion of the pole-ski body 21, there is provided a guard member 24 projecting upright from said upper surface to prevent the pole-ski body 21 from being casually stepped on by the ski S.

The aforesaid pole member 1 is to be attached to the pole-ski body 21 at substantially the central part of the pole-ski member 2 by utilizing a uniting means, i.e., the previously mentioned holding member 3. Arrangement is provided by said holding member 3 so that this pole member 1 is adapted to be held in its erected position and also in a substantially parallely straightly extending posture relative to the pole-ski member 2.

The holding member 3 comprises a horizontal base plate 31 and an upright guide plate 32 having an arcuate edge 32*a* of a quadrant of a circle and extending upright from the central portion of said base plate 31. Notches 32*b* and 32*b'* are provided, one at the upper top and the other at the lower side end, of the arcuate edge 32*a*. The bottom of this upright guide plate 32 is affixed to the horizontal base plate 31. The arcuate edge 32*a* of the upright guide plate 32 is positioned so that its forward part faces the forward end of the pole-ski member 2. A stopper 33 lined with an elastic material such as rubber which extends beyond said arcuate edge from the rear end of the upright guide plate 32.

The horizontal base plate 31 is fixed to the pole-ski body 21 by means of screws 34 and, in addition, screws 35 each having a pin-receiving hole in its head portion are screwed into the pole-ski body 21 via the horizontal base plate 31. These screws 35 are located just below the center line 32c of the arcuate shape 32a of the guide plate 32.

It should be noted that the aforesaid holding member 3 is provided between the pole member 1 and the pole-ski member 2, and that it is necessary to have the pole member 1 held by this holding member 3. To this end, first of all, there is provided the aforesaid attachment member 16 of the pole member 1 in such a way that this member 16 straddles the upright guide plate 32 and that the lower end of this attachment member 16 is pivotably supported by a pin 36 at the center line 32*c* of the arcuate shape 32*a*.

Screws 37 and 37 each having a pin-receiving throughhole in its head portion are screwed into the threaded holes 15*a* and 15*a* of the arms 15 and 15 provided on the pole body 11 or moree particularly on its lower end member 14, respectively. One end of a spring 38 is anchored to the pin-receiving hole of the screw 35 which is threaded into the horizontal base plate 31 and the other end of the spring 38 engages the pin-receiving hole of the screw 37. A similar spring 38 is arranged in the same fashion on diametrically the opposite side of the pole body 11. Thus, the pole member 1 is held by the holding member 3 so that it is allowed to make rotation within certain limits relative to the holding member 3. For example, when the pole body 11 is in its erect position, the ball 17 which is housed in the bore of the attachment member 16 is in its state of being pushed into the notch 32b located at the upper top of the arcuate edge 32a of the upright guide plate 32 by the action of the spring 18, and thereby the pole body 11 is held in its erect position. In addition, side edges 4 having numerous indentations at their lateral sides are fixed to the middle portion of the sides of the pole-ski member 2.

Next, description will be made on the manner of skiing by a single leg, using the ski-equipped crutches according to the present invention. It should be understood that initially each pole member 1 is to be used, normally, in a position perpendicular to the pole-ski member 2. In such an instance, the ball 17 housed in the attachment member 16 which is located at the bottom end of the pole member 1 is received in the notch 32*b* which is formed at the upper top of the arcuate edge 32*a* of the upright guide plate 32 of the holding member 3 by the action of the spring 18, thereby maintaining the erect posture of the pole member 1. When it is intended to have this ball 17 escape from the notch 32*b*, it is only necessary to tilt down the pole member 1 along the arcuate edge 32*a* of the upright guide plate 32. This operation is accomplished with the movement of the pole member 1 being assisted by the force of the springs 38.

Figure 9:
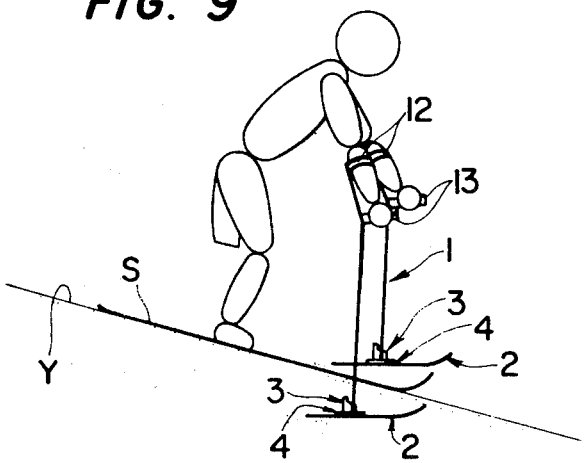
FIG. 9 is a perspective view showing the state in which the ski-equipped crutches of the present invention are in use.

In the erect state of each pole member 1 relative to its mating ski member 2, the right and the left arms of the user are passed through the arm-receiving rings 12, respectively, which are provided on the upper ends of the pole bodies 11 of the pole members, respectively, and then the right and the left hands grasp the handles 13, respectively. On the other hand, the foot of the user wears the ski S. The skier performs skiing while being supported at three points, i.e., by a pair of skis provided on the poles and also by the single ski worn by the skier himself (FIG. 9).

In case it is intended to ski at a substantial speed, it will be noted that the braking power from only a single ski is not enough and that a sufficiently powerful braking power is required to insure safety of the physically handicapped or like skier. Therefore, in such an instance of skiing performed at some speed, the pole-member of the ski-equipped crutch according to the present invention is thrusted toward a substantially forward position, with the lower end of the pole member 1 parted farther from the body of the user than is its upper end, and along therewith the foward end portion of the pole-ski body 21 is positioned away from the snow surface Y (as shown in FIG. 1) whereas the rear protector 23 which is located at the rear end of the pole ski body is brought into contact with the snow surface Y, to thereby obtain a powerful braking power.

Apart from the above, when it is intended to make one-legged walk on the snow surface Y without wearing a ski, there is the need to use some kind of canes. The pole members, according to the present invention, can be used as the walk-assisting canes in such an instance. In such case, first of all, each pole member 1 is rotated or tilted about the pin 36 along the arcuate shape 32*a* of the upright guide plate 32 toward the forward end of the pole-ski member 2.

Then the pole member 1 is in the state of being pulled to the pole-ski member 2 side by the springs 38. Since the ball 17 is in its state of being pushed into the notch 32*b* and engaged thereby by the action of the spring 18, the operation of rotating the pole member 1 requires a power to push the ball 17 of the attachment member 16 backwardly into the bore 16*a* against the force of the spring 18.

As the pole member is rotated along the arcuate shape 32*a* of the upright guide plate 32, the ball 17 will come to be positioned in register with the notch 32*b'* provided at the side edge of the arcuate edge 32*a* of the guide plate, whereat the ball 17 is received in the notch 32*b'* by the action of the spring 18. Whereupon, the pole member 1 is rendered substantially rectilinear relative to the pole-ski member 2. Along therewith, the cutout 22 formed at the foremost end of the pole-ski member 2 receives therein the pole member 1. Thus, there never occurs that the "top bend" which is formed at the forward end of the pole-ski member 2 hits the pole body 11 and that thereby this "top bend" becomes a hindrance.

As stated, each pole member 1 and each pole-ski member 2, as a combination, will thus provide a rectilinear cane. Therefore, the edge 23*a* of the rear protector 23 will now face the surface of the ground, serving as the ferrule. As such, the resulting cane-like pole can be used as a walk-assisting crutch in case a one-legged person walks on the snow and yet there will occur no skidding at all.

As will be clear from the above description, according to the present invention, a pole-ski member is pivotably supported at the bottom of the pole member and on this latter member. Accordingly, in case a person having a disabled leg wants to enjoy skiing, for example, by skiing on one leg, he can do so in safety if he supports two poles by his arms, wearing a ski on his leg, and if he stands on the snow surface while being supported at these three points and if he starts skiing under such condition. Where a particularly powerful braking force is needed, it is only necessary to perform 'edging' by utilizing the rear protector. Furthermore it is possible to bring both the pole member and the pole-ski member substantially into a substantially rectilinear posture, from the initial positions of these two members crossing each other at right angle forming an inverted T-shape. Thus, these straightly aligned members can be used as walk-assisting crutches. Therefore, these straightly aligned members are conveniently used at the time of walking on a snow surface. As such, the poles of the present invention can give physically handicapped persons also a way to experience the pleasure of skiing by themselves.

Next, when it is intended to perform skiing on one leg with safety, the ski-equipped crutches or poles grasped by both hands will serve as important assisting means. In particular, these ski-equipped poles require to be adjusted of their overall lengths so as to be appropriate relative to the height of their user. Thus, there arises the necessity that the lengths of the pole members can be adjusted easily.

Hence, another aspect of the present invention lies in the provision of a ski-equipped crutch which, in addition to the previous features of enabling the user to enjoy speed in one-legged skiing and to exercise good control of the speed, enables the user to select a desired overall length of the pole member from a plurality of positions by a very simple procedure without the need of replacing any parts of the crutch, to match the physical frame, especially the height of the user.

This aspect of the present invention will be discussed hereunder by referring to the accompanying drawings.

Figure 7:
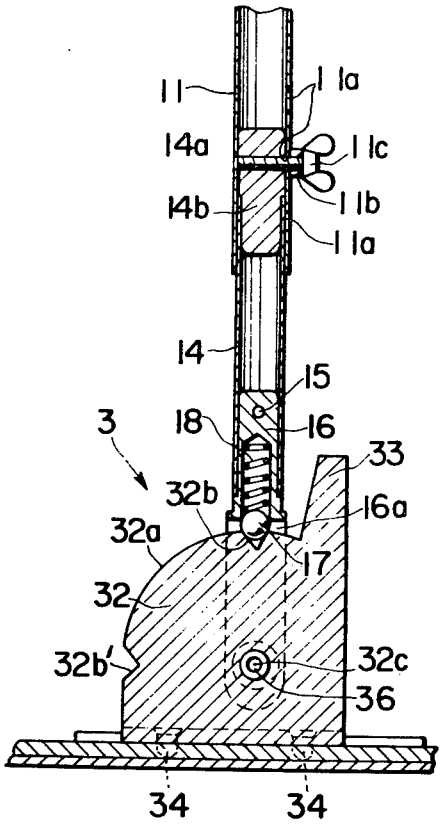
FIG. 7 is a sectional view of the ski-equipped crutch according to another aspect of the present invention.
Figure 8:
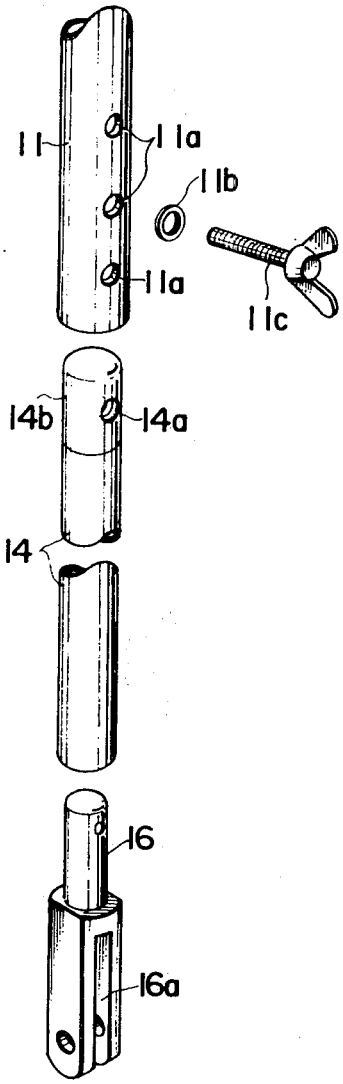
FIG. 8 is a perspective view, in exploded fashion, of the elements constituting the pole member and the fastening means.

Referring to FIGS. 7 and 8, the pole body 11 are provided, on one side of its tubular circumference at sites closer to its lower end, with a plural number of through-holes 11*a* at equal intervals. It should be understood that these through-holes 11*a* need not be provided at equal intervals. A thumbscrew 11*c* is provided, which is screwed into one of these through-holes 11a of the pole body 11 via a washer 11*b*.

At the upper end of the lower end member 14 which is of a tubular shape whose upper end portion is received in the lower end portion of the pole body 11, there is provided a head portion 14*b* which is not tubular in shape but solid and integral with said upper end of the lower end member 14 and which has, at a position closer to its upper end, a threaded female hole 14*a* formed radially through this solid head portion 14*b*.

The one-legged skier, when intended to ski, wears a ski on his foot and grasps the poles of the crutches in his hands. Then he assumes a forwardly tilted posture and starts, with the lower ends of the pole members thrusted forwardly. In such an instance, if the lengths of the pole members 1 are not matched adequately with the height of the skier, the latter will soon develop fatique and will become unable to enjoy pleasant skiing.

Therefore, in order to obtain a length of the pole member 1 matched with the physical frame of the user, the lower end member 14 which is slidably inserted into the lower end portion of the pole body 11 is moved axially relative the pole body 11 to adjust or alter the overall length of the pole member 1. This adjustment or alteration is accomplished by selecting a desired one from among the plural female threaded holes 14*a* provided in the head portion 14*b* of the lower end member 14 though only one such hole 14*a* is shown for the sake of simplicity and by selecting a desired one from among a plural number of holes 11a formed through one wall of the tubular pole body 11, and then by screwing the thumbscrew 11*c* into the selected hole 11*a* and the selected female threaded hole 14*a*, followed by tightly fastening the pole body 11 to the head portion 14*b* of the lower end member 14 via the washer 11*b*. Thus, the skier can select the length of the pole members which enables him to assume his optimum forwardly tilted posture for enjoying pleasant skiing.

Besides, when the skier desires to transport or carry the ski-equipped crutches before or after skiing, he may unscrew the thumbscrews to dismantle the pole member 1 into several separate parts. By doing so, the ski-equipped crutches can be transported conveniently.

Description has been made wherein the pole member 1 is divided into the pole body 11 and the lower end member 14 having an integral head portion 14*b* so that the alteration of the length of the pole member 1 is effected by changing the relative positions of these two members with the assistance of a fastening thumb screw 11*c*. It should be understood that the pole member 1 may be divided into more than two sub-members so that they may be fastened together at more than one site.

I claim:

1. A ski-equipped crutch comprising: a pole member, a pole-ski member, a holding member fixedly attached to said pole-ski member and rotatably attached to said pole member, said holding member including a guide plate having a smooth guiding free end surface provided with spaced notches, an elastic engaging means for releasably locking said pole member and said holding member into engagement with each other at at least first and second selected positions, in said first position said ski pole member being substantially perpendicular to the longitudinal direction of said pole member and in said second position said ski pole member being substantially aligned with said pole member, said engaging means including a tubular bifurcated lower end portion formed in said pole member, said holding member being received in said bifurcated lower end portion, a ball movably received between said tubular lower end portion of the pole member and said guiding surface of said holding member, and a biasing means received within said tubular lower end portion and acting along the longitudinal direction of said pole member for urging said ball into engagement with said guide surface, said ball moving in and out of said notches and smoothly along said guide surface when a force urging rotation of said pole member with respect to said pole-ski member exceeds the biasing force urging said ball into said notches.

2. A ski-equipped crutch according to claim 1, in which said pole-ski member has at its forward end a bent forward portion with a cutout having a breadth somewhat greater than the outer diameter of the pole member and with a length that, as the pole member and the pole-ski member are rotated toward each other into an aligned superposed straight position, the pole member is kept from being hit by the edge of the bent forward end portion of the pole-ski member.

3. A ski-equipped crutch according to claim 1 wherein said pole-ski member further comprises a rear protector secured to the rear of said pole-ski member, said rear protector having a serrated edge spaced with respect to a plane defined by the bottom surface of said pole-ski member.

4. The ski-equippeed crutch of claim 3 wherein said pole member further includes means for altering the length thereof, said altering means including at least two sub-members of the pole member, one of said sub-members being a tubular pole body having spaced holes formed on one side of its circumference, a tubular lower end member slidably received in said tubular pole body and having a solid head portion formed integrally at its top for being received in said tubular pole body and being provided with at least one threaded hole, and a screw member extending through one of said spaced holes and said threaded hole when the tubular lower end member having said head portion is received in said tubular pole body.

* * * * *